US011719474B2

(12) United States Patent
Chen et al.

(10) Patent No.: US 11,719,474 B2
(45) Date of Patent: Aug. 8, 2023

(54) REFRIGERATION CABINET HAVING TWO EVAPORATORS AND OPERATION METHOD OF THE SAME

(71) Applicant: DELTA ELECTRONICS, INC., Taoyuan (TW)

(72) Inventors: Lee-Long Chen, Taoyuan (TW); Chun-Yang Hung, Taoyuan (TW); Chia-Wei Chen, Taoyuan (TW); Yi-Chung Chou, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 140 days.

(21) Appl. No.: 17/017,661

(22) Filed: Sep. 10, 2020

(65) Prior Publication Data

US 2021/0088261 A1 Mar. 25, 2021

(30) Foreign Application Priority Data

Sep. 19, 2019 (CN) ..... 201910884236.9

(51) Int. Cl.

| | |
|---|---|
| ***F25B 5/02*** | (2006.01) |
| ***F25B 39/02*** | (2006.01) |
| ***F25D 29/00*** | (2006.01) |
| *F25B 47/02* | (2006.01) |
| *F25D 21/04* | (2006.01) |

(52) U.S. Cl.

CPC ..... *F25B 39/022* (2013.01); *F25B 5/02* (2013.01); *F25D 29/00* (2013.01); *F25B 47/02* (2013.01); *F25B 2339/02* (2013.01); *F25D 21/04* (2013.01); *F25D 2700/02* (2013.01); *F25D 2700/12* (2013.01)

(58) Field of Classification Search

None

See application file for complete search history.

(56) References Cited

U.S. PATENT DOCUMENTS

| | | | | |
|---|---|---|---|---|
| 4,406,138 | A * | 9/1983 | Nelson | F25D 17/02 62/305 |
| 4,771,269 | A * | 9/1988 | Pasty | E05B 17/22 200/61.69 |
| 2004/0168456 | A1* | 9/2004 | Chiang | F25B 39/02 165/182 |
| 2006/0254308 | A1* | 11/2006 | Yokoyama | F25D 21/08 62/500 |
| 2010/0107661 | A1 | 5/2010 | Awwad et al. | |
| 2015/0047380 | A1* | 2/2015 | Liao | F25B 5/02 62/155 |

(Continued)

FOREIGN PATENT DOCUMENTS

| | | | |
|---|---|---|---|
| CN | 2886467 | Y | 4/2007 |
| CN | 101922838 | A | 12/2010 |

(Continued)

*Primary Examiner* — Jerry-Daryl Fletcher
*Assistant Examiner* — Daniel C Comings
(74) *Attorney, Agent, or Firm* — CKC & Partners Co., LLC

(57) ABSTRACT

A refrigeration cabinet includes a freezing compartment, a first evaporator and a second evaporator. The freezing compartment includes a freezing compartment door, and the first evaporator and the second evaporator are both equipped in the freezing compartment. The first evaporator is turned off and a second evaporator is working while the freezing compartment door is opened.

18 Claims, 5 Drawing Sheets

(56) References Cited

U.S. PATENT DOCUMENTS

2018/0334846 A1* 11/2018 Eom ..... E05F 15/73

FOREIGN PATENT DOCUMENTS

| | | | |
|---|---|---|---|
| CN | 104236150 | A | 12/2014 |
| CN | 206817842 | U | 12/2017 |
| CN | 108426412 | A | 8/2018 |
| CN | 109990548 | A | 7/2019 |
| CN | 209960792 | U | 1/2020 |
| CN | 112237357 | A | 1/2021 |
| DE | 3333903 | A1 | 3/1985 |
| TW | M492426 | U | 12/2014 |

* cited by examiner

REFRIGERATION CABINET HAVING TWO EVAPORATORS AND OPERATION METHOD OF THE SAME

RELATED APPLICATIONS

This application claims priority to China Application Serial Number 201910884236.9, filed Sep. 19, 2019, which is herein incorporated by reference.

TECHNICAL FIELD

The present disclosure generally relates to a refrigeration cabinet and operation method thereof. More particularly, the present disclosure relates to a car refrigeration cabinet and operation method thereof.

BACKGROUND

With the improvement of the quality of life, the frozen transport has become an indispensable transportation method to deliver the fresh food. In a traditional frozen transport, the refrigerated air conditioner utilizes a controller to detect the temperature of the refrigeration cabinet of the car. When the temperature is too high, the solenoid valve is turned on to transfer an engine power to the compressor and drive the compressor to compress the high temperature refrigerant and transfer the same to the condenser. In addition, a condenser fan blows the outside air through the condenser to bring out the heat.

The internal refrigerant is cooled to become liquid, and the pressure thereof is reduced after passing through a capillary or an expansion valve. The low temperature refrigerant flows into the evaporator, and the evaporator fan blows a high temperature air inside the refrigeration cabinet through the low temperature evaporator. The temperature of the air is reduced to cool down the refrigeration cabinet. In addition, the evaporator absorbs the energy of the air to gasify the refrigerant and then the refrigerant flows back to the compressor.

However, when the car with the refrigeration cabinet arrives at a store, the door of the refrigeration cabinet is opened to pick up or unload the fresh foods, and the higher temperature air with higher humidity outside the refrigeration cabinet may quickly flow into the refrigeration cabinet. Because the evaporator in the refrigeration cabinet is extremely cold, the aluminum fins of the evaporator may therefore easily freeze. The air gaps of the aluminum fins are blocked by the ice and therefore the air cannot flow through the evaporator, thereby decreasing the cooling efficiency of the refrigeration cabinet, which may affect the preservation of the low temperature fresh foods.

Therefore, conventionally, when the driver finds that the aluminum fins of the evaporator are frozen or the temperature of the refrigeration cabinet is insufficient, the evaporator is heated to dissolve the ice on the aluminum fins. After the ice is removed, the evaporator is restarted and the refrigeration cycle is resumed. However, the refrigeration cabinet is difficult to maintain at a low temperature when the evaporator is under a deice process, thereby affecting the preservation of the low-temperature fresh foods.

SUMMARY

One objective of the embodiments of the present invention is to provide a refrigeration cabinet and a refrigeration cabinet operation method to prevent from blocking heat dissipation fins of evaporators in the refrigeration cabinet, thereby improving the cooling efficiency and quality of the refrigeration cabinet.

To achieve these and other advantages and in accordance with the objective of the embodiments of the present invention, as the embodiment broadly describes herein, the embodiments of the present invention provide a refrigeration cabinet including a freezing compartment, a first evaporator and a second evaporator. The freezing compartment includes a freezing compartment door, and the first evaporator and the second evaporator are equipped in the freezing compartment. The first evaporator is turned off and the second evaporator is working when the freezing compartment door is opened.

Another embodiment of the present invention provides a refrigeration cabinet including a freezing compartment, a first evaporator and a second evaporator. The freezing compartment includes a freezing compartment door, and the freezing compartment door is equipped with a handle. The first evaporator and the second evaporator are equipped in the freezing compartment. The first evaporator is turned off and the second evaporator is working when the handle is operating.

In some embodiments, the first evaporator is working when the freezing compartment door is closed. In some embodiments, the second evaporator is turned off when the freezing compartment door is closed.

In some embodiments, the first evaporator is working at a first predetermined time and the second evaporator is turned off at a second predetermined time after the freezing compartment door is closed. The first predetermined time is less than or equal to the second predetermined time.

In some embodiments, the second evaporator is working when the freezing compartment door is opened or detected to be opened. In some embodiments, a density of heat dissipation fins of the first evaporator is greater than a density of heat dissipation fins of the second evaporator.

In some embodiments, the refrigeration cabinet includes at least one sensor detecting whether the freezing compartment door is opened or closed, wherein the sensor includes a temperature sensor, a humidity sensor, an infrared motion sensor or a door position sensor. The sensor may further include a pressure sensor, a handle position sensor ora fingerprint sensor.

According to another aspect of the present invention, the embodiments of the present invention provide a refrigeration cabinet operation method suitable for a freezing compartment having a freezing compartment door, a first evaporator and a second evaporator, and a density of heat dissipation fins of the first evaporator is greater than a density of heat dissipation fins of the second evaporator. The refrigeration cabinet operation method includes steps of opening the freezing compartment door, turning off the first evaporator and turning on the second evaporator.

In some embodiments, the first evaporator is working at a first predetermined time and the second evaporator is turned off at a second predetermined time after the freezing compartment door is closed.

In some embodiments, the first predetermined time is less than or equal to the second predetermined time.

In some embodiments, the second evaporator is working when the freezing compartment door is opened or detected to be opened.

Hence, the refrigeration cabinet and the refrigeration cabinet operation method can convert all the energy into the refrigeration capacity without using the heating defrost and de-icing processes so as to continuously provide the low temperature capacity, thereby improving the quality of frozen and refrigerated transport and further improving the efficiency and quality of the low temperature transport.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF THE PREFERRED EMBODIMENT

The following description is of the best presently contemplated mode of carrying out the present disclosure. This description is not to be taken in a limiting sense but is made merely for the purpose of describing the general principles of the invention. The scope of the invention should be determined by referencing the appended claims.

Figure 1:
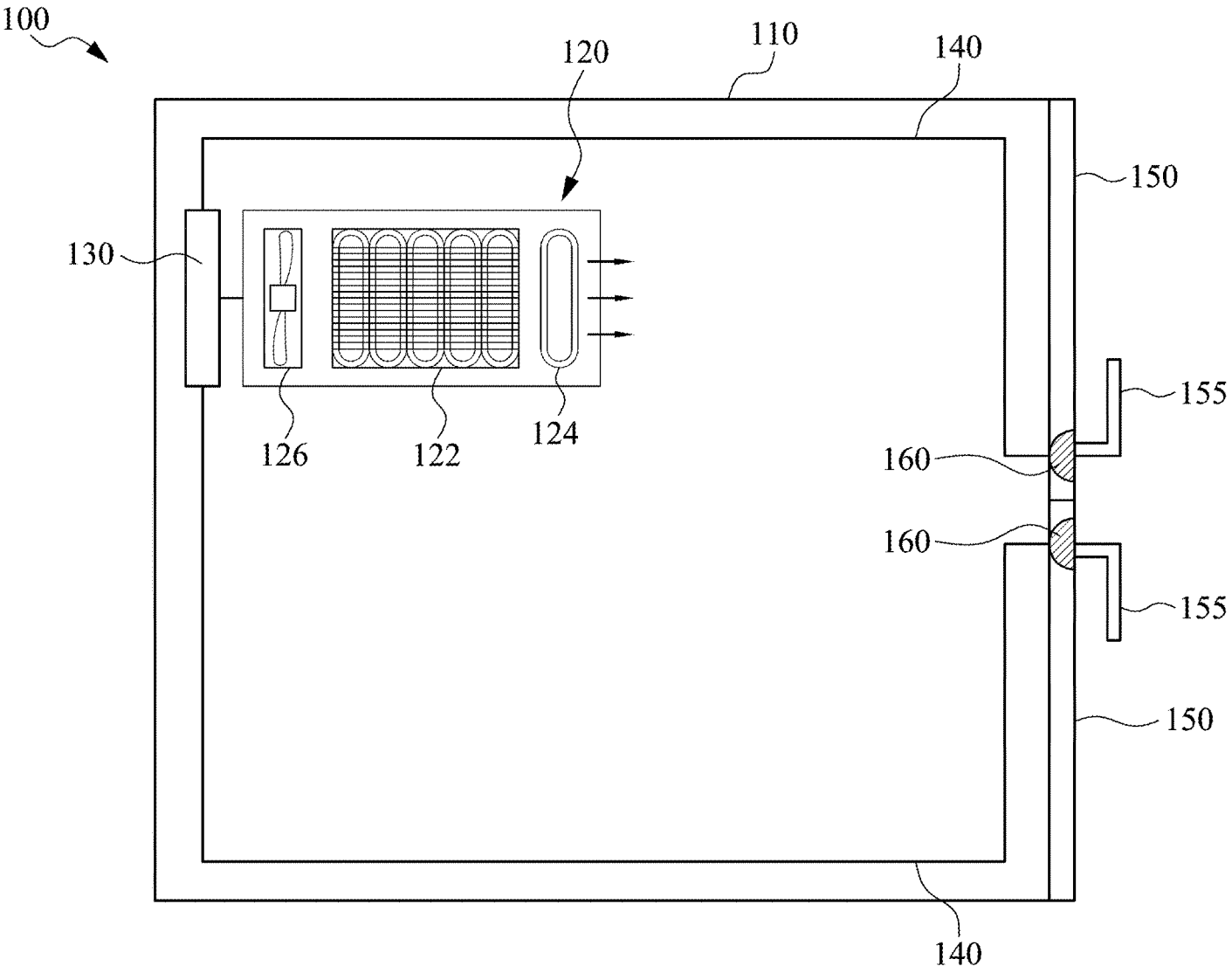
FIG. 1 illustrates a schematic view of a refrigeration cabinet according to one embodiment of the present invention.
Figure 2A:
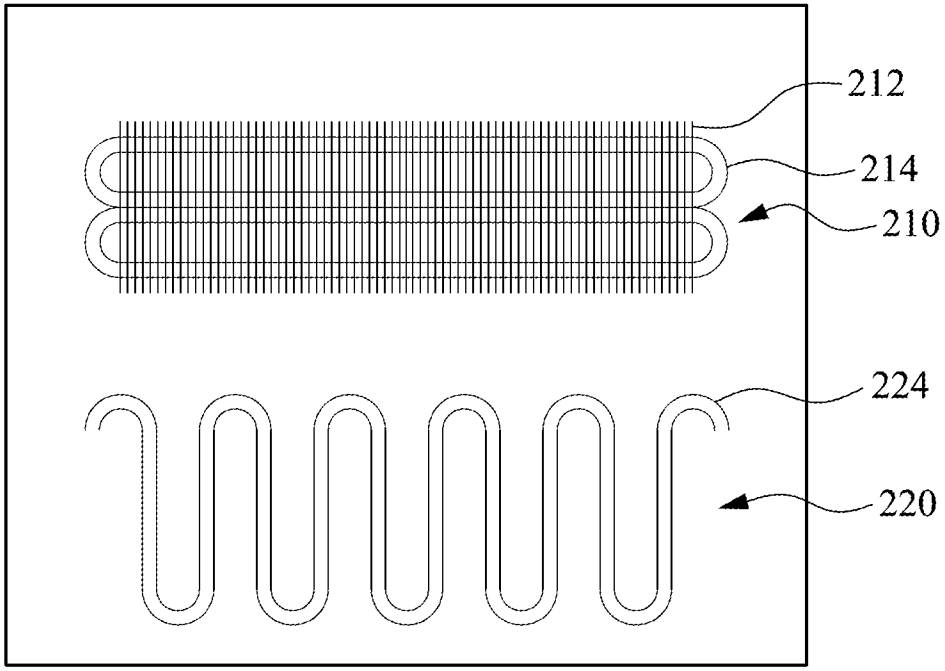
FIG. 2A illustrates a schematic partial view of an evaporator of the refrigeration cabinet according to one embodiment of the present invention.
Figure 2B:
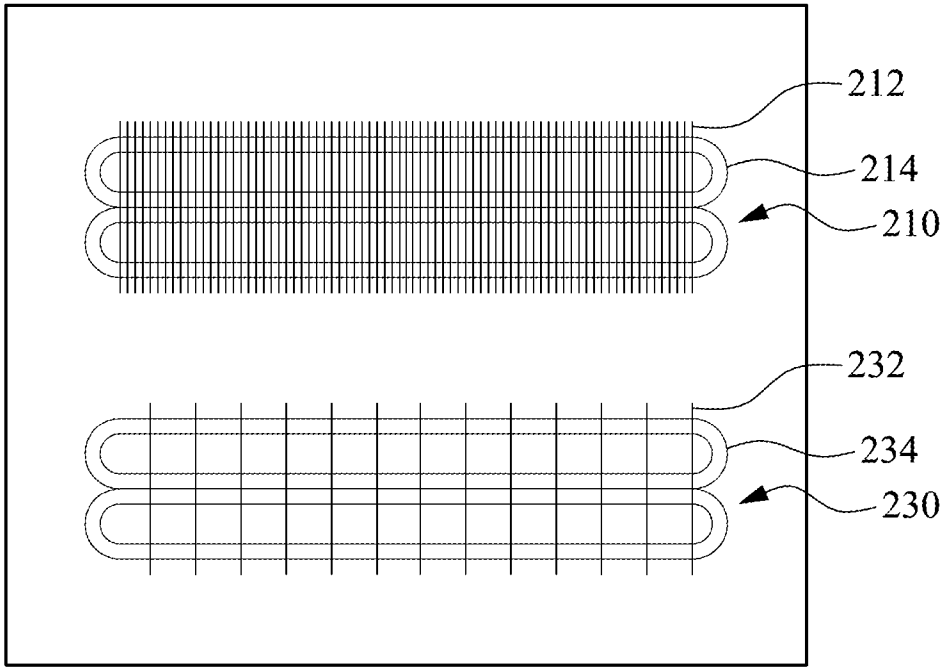
FIG. 2B illustrates a schematic partial view of an evaporator of the refrigeration cabinet according to another embodiment of the present invention.
Figure 3:
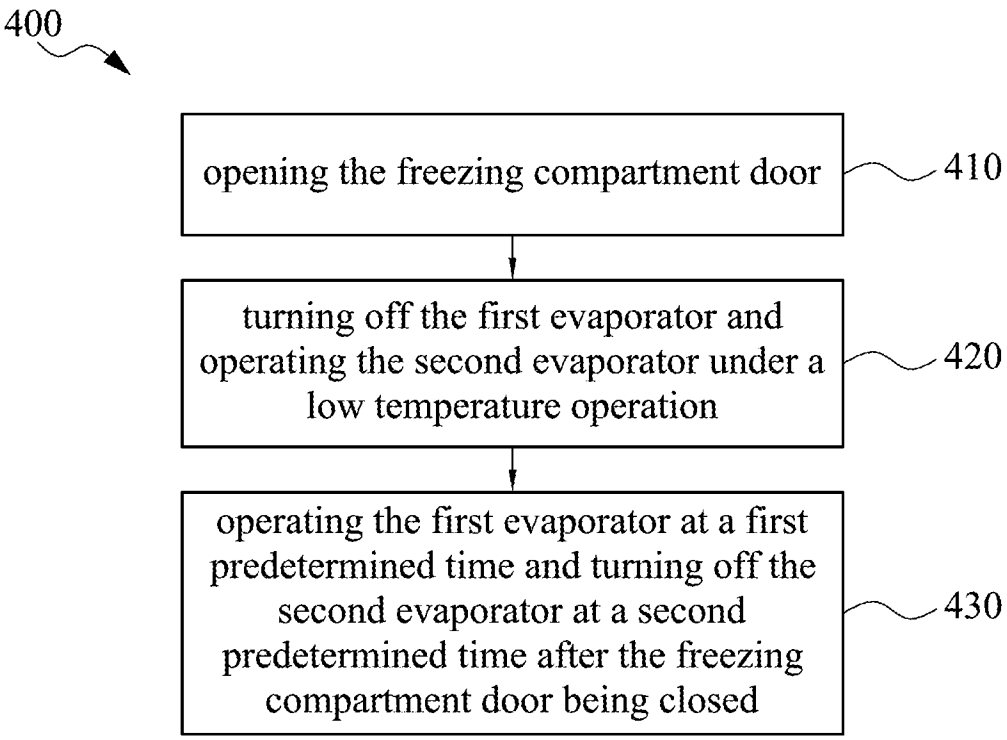
FIG. 3 illustrates a schematic flow diagram of a refrigeration cabinet operation method according to another aspect of the present invention.
Figure 4:
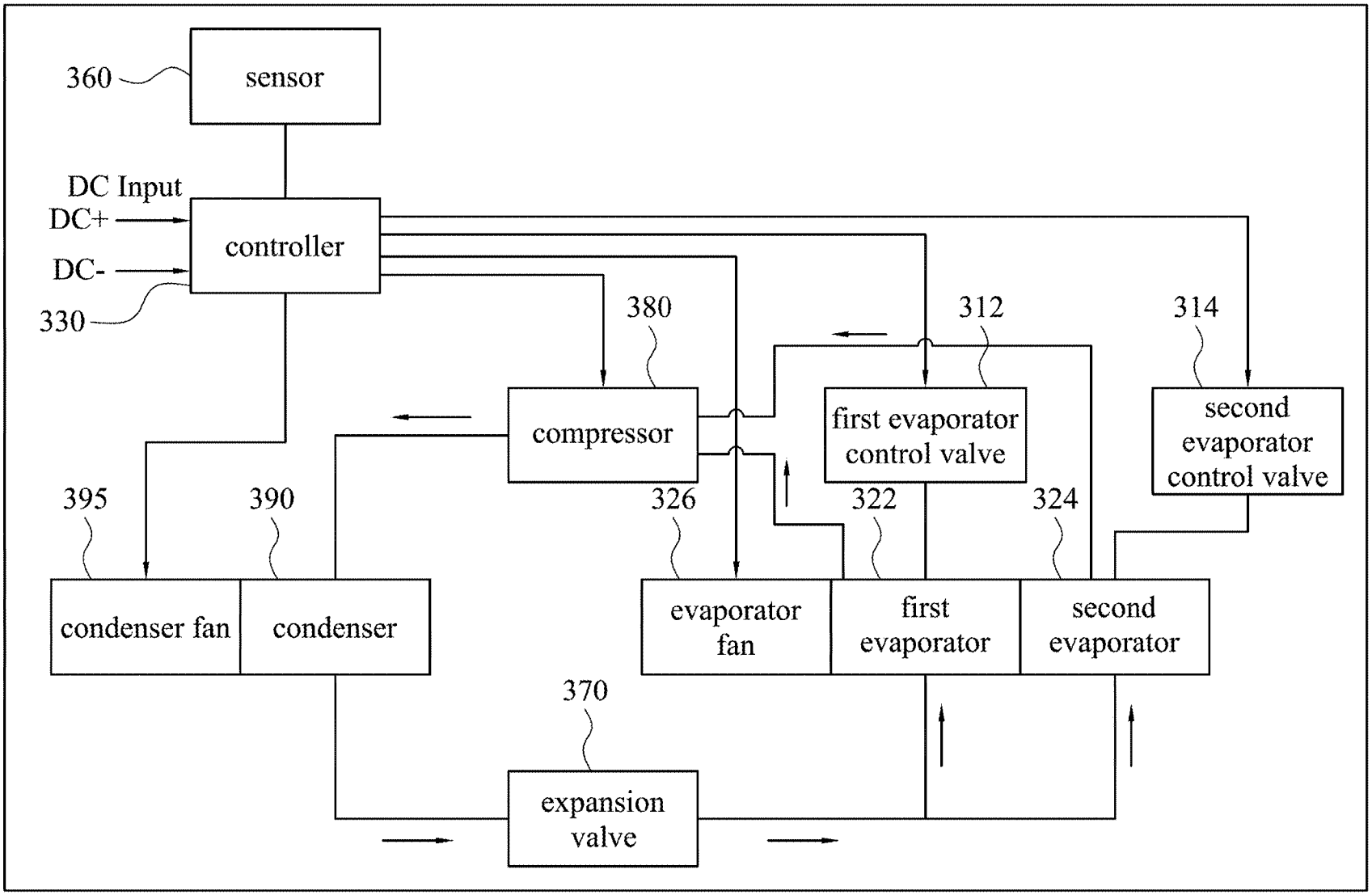
FIG. 4 illustrates a schematic block diagram of a refrigeration cabinet according to one embodiment of the present invention.

FIG. 1 illustrates a schematic view showing of a refrigeration cabinet according to one embodiment of the present invention, FIG. 2A and 2B illustrate schematic partial views showing of the evaporators of the refrigeration cabinet, FIG. 3 illustrates a schematic flow diagram showing of a refrigeration cabinet operation method, and FIG. 4 illustrates a schematic block diagram of the refrigeration cabinet.

Referring to FIG. 1, the refrigeration cabinet 100 includes a freezing compartment 110, a first evaporator 122 and a second evaporator 124.

The freezing compartment 110 includes a freezing compartment door 150 and a handle 155 equipped on the freezing compartment door 150. The first evaporator 122 and the second evaporator 124 are equipped in the freezing compartment 110. When the freezing compartment door 150 is opened, the first evaporator 122 is turned off and the second evaporator 124 is turned on. If the second evaporator 124 is working before the freezing compartment door 150 will be opened, the second evaporator 124 keep working while the freezing compartment door 150 is opened. Therefore, the second evaporator 124 can maintain the temperature of the refrigeration cabinet 100 when the freezing compartment door 150 is opened. Further, the first evaporator 122 can prevent frost formation. In addition, the first evaporator 122 is preferably turned off while opening the freezing compartment door 150 or before opening the freezing compartment door 150. That is to say, the first evaporator 122 is turned off at least before the freezing compartment door 150 is opened. In addition, the second evaporator 124 is working while opening the freezing compartment door 150 or before opening the freezing compartment door 150. That is to say, the second evaporator 124 is working at least before the freezing compartment door 150 is opened.

In some embodiments, the refrigeration cabinet 100 further includes a controller 130, an evaporator fan 126 and at least one sensor 160. The sensor 160 is connected to the controller 130 through the line 140 to transmit the sensed signals to the controller 130 to determine whether the freezing compartment door 150 is opened or to be opened. In some embodiments, the freezing device 120 includes the first evaporator 122, the second evaporator 124 and the evaporator fan 126. In addition, the freezing device 120 may further include a compressor, a condenser and an expansion valve without departing from the spirit and scope of the present invention.

In some embodiments, the sensor 160 can be a temperature sensor, a humidity sensor, an infrared motion sensor, a door position sensor, a pressure sensor, a door handle position sensor or a fingerprint sensor without departing from the spirit and scope of the present invention.

In some embodiments, when the sensor 160 is a temperature sensor, the controller 130 determines whether the freezing compartment door 150 is opened according to the temperature variation sensed by the sensor 160, for example, when the temperature variation is around 1%, 2%, 5%, 10%, 15% or 20% in a predetermined period, the controller 130 determines the freezing compartment door 150 is opened.

In some embodiments, when the sensor 160 is a humidity sensor, the controller 130 determines whether the freezing compartment door 150 is opened according to the humidity variation sensed by the sensor 160, for example, when the humidity variation is around 1%, 2%, 5%, 10%, 15% or 20% in a predetermined period, the controller 130 determines the freezing compartment door 150 is opened.

In some embodiments, when the sensor 160 is a door position sensor, the controller 130 determines whether the freezing compartment door 150 is opened or closed according to the door position variation sensed by the sensor 160. In addition, the door position sensor can be a micro switch.

In some embodiments, when the sensor 160 is an infrared motion sensor, the controller 130 determines whether the freezing compartment door 150 will be opened or closed according to a sensed human position and a sensed human posture conforming to a predetermined human position and a predetermined human posture.

In some embodiments, when the sensor 160 is a pressure sensor, the controller 130 determines whether the freezing compartment door 150 will be opened according to a sensed pressure force conforming to a predetermined pressure force.

In some embodiments, when the sensor 160 is a handle position sensor, the controller 130 determines whether the freezing compartment door 150 will be opened or closed according to the movement or rotation of the handle.

In some embodiments, when the sensor 160 is a fingerprint sensor, the controller 130 determines whether the freezing compartment door 150 will be opened or closed according to the fingerprint sensed by the sensor 160.

In some embodiments, the evaporator fan 126, the first evaporator 122 and the second evaporator 124 of the refrigeration cabinet 100 are arranged in series. In other embodiments, the evaporator fan 126 can be arranged between the first evaporator 122 and the second evaporator 124 without departing from the spirit and scope of the present invention.

Referring to FIG. 2A, the first evaporator 210 includes a refrigerant pipe 214 and a plurality of heat dissipation fins 212, and the second evaporator 220 has a refrigerant pipe 224 without heat dissipation fins. Since the refrigerant pipe 224 has no heat dissipation fins, the icing probability on the first evaporator 210 and the second evaporator 220 can be effectively reduced when the freezing compartment door 150 is opened, thereby improving the overall cooling efficiency of the refrigeration cabinet.

Referring to FIG. 2B, the difference between FIG. 2A and 2B is that the second evaporator 230 includes a refrigerant pipe 234 and a plurality of heat dissipation fins 232. The gap between adjacent heat dissipation fins 232 is greater than the gap between adjacent heat dissipation fins 212. Therefore, when the freezing compartment door 150 is opened, the icing probability on the first evaporator 210 and the second evaporator 230 can be effectively reduced and the cooling efficiency of the second evaporator 230 is therefore increased, thereby further improving the overall cooling efficiency of the refrigeration cabinet. In addition, the density of the heat dissipation fins 212 of the first evaporator 210 is preferably greater than the density of the heat dissipation fins 232 of the second evaporator 230.

In some embodiments, when the freezing compartment door 150 is closed, the first evaporator 122 is working and the second evaporator 124 is continuously working to maintain the low temperature operation. In addition, the second evaporator 124 can be turned off after the freezing compartment door 150 is closed as needed.

In some embodiments, when the freezing compartment door 150 is closed, the first evaporator 122 is working at a first predetermined time and the second evaporator 124 is turned off at a second predetermined time to maintain the low temperature operation. In some embodiments, the first predetermined time is less or equal to the second predetermined time to efficiently maintain the temperature of the refrigeration cabinet 100. In some embodiments, the first predetermined time may be greater than the second predetermined time to efficiently prevent frost formation.

In some embodiments, when the freezing compartment door 150 is opened, or detected to be opened or be opening, the second evaporator 124 is working to efficiently maintain the temperature of the refrigeration cabinet 100.

Referring to FIG. 3, a schematic flow diagram of a refrigeration cabinet operation method is illustrated. Simultaneously referring to FIG. 1, the freezing compartment 110 includes a freezing compartment door 150, a first evaporator 122 and a second evaporator 124. The density of the heat dissipation fins of the first evaporator 122 is greater than the density of the heat dissipation fins of the second evaporator 124. The refrigeration cabinet operation method 400 includes the following steps. First, step 410, opening the freezing compartment door 150, and step 420, turning off the first evaporator 122 and operating the second evaporator 124 to operate in a low temperature operation and maintain the temperature of the freezing compartment 110 with the second evaporator 124. Subsequently, step 430, after the freezing compartment door 150 is closed, the first evaporator 122 is working at a first predetermined time and the second evaporator 124 is turned off at a second predetermined time.

In some embodiments, the first predetermined time is less than or equal to the second predetermined time to reduce the probability of frost formation on the first evaporator 122 and the second evaporator 124. For example, the first predetermined time can be greater than or equal to one second, two seconds, thirty seconds, one minute, five minutes, ten minutes or longer. The second predetermined time can be greater than or equal to one second, two seconds, three seconds, thirty seconds, one minute, five minutes, ten minutes or longer without departing from the spirit and scope of the present invention.

Referring to FIG. 4, in an exemplary embodiment, when the controller 330 determines the freezing compartment door 150 is prepared to open or opening according to the signal sensed by the sensor 360, the controller 330 turns off the first evaporator control valve 312 of the first evaporator and turns on the second evaporator control valve 314 of the second evaporator to turn off the first evaporator 322 and turn on the second evaporator 324. Meanwhile, a first cooling cycle is operating. The first cooling cycle includes a compressor 380, a condenser 390, an expansion valve 370 and a second evaporator 324. The controller 330 can control the condenser fan 395 to provide the air flow passing through the condenser 390, the evaporator fan 326 to provide the air flow passing through the second evaporator 324 so as to improve the heat exchange efficiency of the condenser 390 and the second evaporator 324.

In the embodiment, the first evaporator 322 has a plurality of heat dissipation fins to increase the cooling effect and the second evaporator 324 has no heat dissipation fins or less heat dissipation fins compared with the first evaporator 322. The density of the heat dissipation fins of the second evaporator 324 is less than the density of the heat dissipation fins of the first evaporator 322. Accordingly, the cooling effect of the first evaporator 322 is higher than the cooling effect of the second evaporator 324. The refrigeration cabinet 100 utilizes the second evaporator 324 with a lower cooling effect when the freezing compartment door 150 is opened to maintain the low temperature of the refrigeration cabinet 100 so as to effectively keep the temperature of the refrigeration cabinet 100 and avoid icing on the first evaporator 322 (main evaporator).

When the controller 330 determines the freezing compartment door 150 is closed according to the signals sensed by the sensor 360, the controller 330 may turn on the first evaporator control valve 312 of the first evaporator to operate the first evaporator 322 according to a preset condition. Meanwhile, a second cooling cycle is operating. The second cooling cycle includes the compressor 380, the condenser 390, the expansion valve 370 and the first evaporator 322 in series.

When the freezing compartment door 150 is closed, the first cooling cycle and the second cooling cycle may be simultaneously operating, or the first cooling cycle is turned off at a predetermined time. In the embodiment, the first cooling cycle and the second cooling cycle are operating with the same compressor 380, the same condenser 390 and the same expansion valve 370. In other embodiments, the first cooling cycle and the second cooling cycle can be operating with different compressors, condensers and expansion valves.

In some embodiments, the condenser fan 395 and the evaporator fan 326 are DC fans. In other embodiments, the condenser fan 395 and the evaporator fan 326 can be AC fans, axial fans, blowers or any other air flow device without departing from the spirit and scope of the present invention. The controller 330 is, for example, a microprocessor, a linkage controller, a manual controller, a switch, etc. In addition, the controller 330 is used to turn off the first evaporator 322, and operate the second evaporator 245.

Accordingly, the refrigeration cabinet and the refrigeration cabinet operation method can convert all the energy into the refrigeration capacity without using the heating defrost and de-icing processes so as to continuously provide the low temperature capacity for the refrigeration cabinet, thereby improving the quality of frozen and refrigerated transport and further improving the efficiency and quality of the low temperature transport.

As is understood by a person skilled in the art, the foregoing preferred embodiments of the present invention are illustrative of the present invention rather than limiting of the present invention. It is intended that various modifications and similar arrangements be included within the spirit and scope of the appended claims, the scope of which should be accorded the broadest interpretation so as to encompass all such modifications and similar structures.

What is claimed is:

1. A refrigeration cabinet, comprising:

a freezing compartment, the freezing compartment comprising a freezing compartment door;

an evaporator fan;

a first evaporator equipped in the freezing compartment; and a second evaporator equipped in the freezing compartment, wherein the evaporator fan, the first evaporator, the second evaporator and the freezing compartment door are arranged in sequence, wherein as the freezing compartment door is opened, the first evaporator is turned off and the second evaporator is working, wherein the first evaporator comprises a refrigerant pipe and a plurality of heat dissipation fins, the second evaporator comprises a refrigerant pipe and a plurality of heat dissipation fins, and a density of the heat dissipation fins of the first evaporator is greater than a density of the heat dissipation fins of the second evaporator.

2. The refrigeration cabinet of claim 1, wherein the first evaporator is working when the freezing compartment door is closed.

3. The refrigeration cabinet of claim 1, wherein the second evaporator is turned off when the freezing compartment door is closed.

4. The refrigeration cabinet of claim 1, wherein the first evaporator is working at a first predetermined time and the second evaporator is turned off at a second predetermined time after the freezing compartment door is closed.

5. The refrigeration cabinet of claim 1, further comprising a controller to turn off the first evaporator and operate the second evaporator.

6. The refrigeration cabinet of claim 1, wherein the second evaporator is working when the freezing compartment door is detected to be opened.

7. The refrigeration cabinet of claim 1, further comprising at least one sensor detecting whether the freezing compartment door is opened or closed, wherein the sensor comprises a temperature sensor, a humidity sensor, an infrared motion sensor or a door position sensor.

8. A refrigeration cabinet, comprising:

a freezing compartment, wherein the freezing compartment comprises a freezing compartment door, and the freezing compartment door is equipped with a handle;

an evaporator fan equipped in the freezing compartment;

a first evaporator equipped in the freezing compartment; and a second evaporator equipped in the freezing compartment, wherein the evaporator fan, the first evaporator, the second evaporator and the freezing compartment door are arranged in sequence, wherein the first evaporator is turned off and the second evaporator is operating when the handle is operating, wherein the first evaporator comprises a refrigerant pipe and a plurality of heat dissipation fins, the second evaporator comprises a refrigerant pipe and a plurality of heat dissipation fins, and a density of the heat dissipation fins of the first evaporator is greater than a density of the heat dissipation fins of the second evaporator.

9. The refrigeration cabinet of claim 8, wherein the first evaporator is working when the freezing compartment door is closed.

10. The refrigeration cabinet of claim 8, wherein the second evaporator is turned off when the freezing compartment door is closed.

11. The refrigeration cabinet of claim 8, wherein the first evaporator is working at a first predetermined time and the second evaporator is turned off at a second predetermined time after the freezing compartment door is closed.

12. The refrigeration cabinet of claim 8, further comprising a controller to turn off the first evaporator and operate the second evaporator.

13. The refrigeration cabinet of claim 8, wherein the second evaporator is working when the freezing compartment door is opened or detected to be opened.

14. The refrigeration cabinet of claim 8, further comprising at least one sensor detecting whether the handle is operating, wherein the sensor comprises a pressure sensor, a handle position sensor, a fingerprint sensor, or an infrared motion sensor.

15. An operation method of a refrigeration cabinet comprising a freezing compartment having a evaporator fan, a first evaporator, a second evaporator and a freezing compartment door arranged in sequence, the first evaporator comprising a refrigerant pipe and a plurality of heat dissipation fins, the second evaporator comprising a refrigerant pipe and a plurality of heat dissipation fins, and a density of the heat dissipation fins of the first evaporator greater than a density of the heat dissipation fins of the second evaporator, the operation method comprising:

opening the freezing compartment door; and turning off the first evaporator and working the second evaporator.

16. The operation method of claim 15, wherein the first evaporator is working at a first predetermined time and the second evaporator is turned off at a second predetermined time after the freezing compartment door is closed.

17. The operation method of claim 15, further comprising:

utilizing a controller to turn off the first evaporator and operate the second evaporator.

18. The operation method of claim 15, wherein the second evaporator is working when the freezing compartment door is opened or detected to be opened.

* * * * *